US010210756B2

(12) United States Patent
Arunachalam

(10) Patent No.: US 10,210,756 B2
(45) Date of Patent: Feb. 19, 2019

(54) EMERGENCY VEHICLE ALERT SYSTEM

(71) Applicant: Harman International Industries, Incorporated, Stamford, CT (US)

(72) Inventor: Srinath Arunachalam, West Jordan, UT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/658,298

(22) Filed: Jul. 24, 2017

(65) Prior Publication Data

US 2019/0027032 A1 Jan. 24, 2019

(51) Int. Cl.
*G08G 1/0965* (2006.01)

(52) U.S. Cl.
CPC ..... *G08G 1/0965* (2013.01)

(58) Field of Classification Search
CPC ..... G08G 1/0965
USPC ..... 340/902
See application file for complete search history.

(56) References Cited

U.S. PATENT DOCUMENTS 4,764,978 A * 8/1988 Argo ..... G08G 1/0965 340/902
6,690,291 B1 * 2/2004 Cardillo ..... B60K 31/0058 340/901
2006/0227008 A1 * 10/2006 Bryant ..... G08G 1/0965 340/902
2007/0159354 A1 * 7/2007 Rosenberg ..... G08G 1/0965 340/902
2016/0355125 A1 * 12/2016 Herbert ..... B60K 35/00

OTHER PUBLICATIONS

Ellis, D., "Detecting Alarm Sounds," Proceedings of Workshop on Consistent and Reliable Acoustic Cues, Sep. 2, 2001, Aalborg, Denmark, 4 pages.
Krishnaveni, V. et al., "Beamforming for Direction-of-Arrival (DOA) Estimation—A Survey," International Journal of Computer Applications, vol. 61, No. 11, Jan. 2013, 8 pages.
Schröder, J. et al., "Automatic Acoustic Siren Detection in Traffic Noise by Part-Based Models," Proceedings of the 2013 IEEE International Conference on Acoustics, Speech, and Signal Processing, May 26, 2013, Vancouver, B.C., Canada, 5 pages.
(Continued)

*Primary Examiner* — Ojiako K Nwugo
(74) *Attorney, Agent, or Firm* — McCoy Russell LLP

(57) ABSTRACT

Examples are provided for locating an emergency vehicle relative to another vehicle. An example in-vehicle computing system of a first vehicle includes an alert output device, a sensor subsystem communicatively coupled to one or more of an audio sensor and an image sensor, a processor, and a storage device storing instructions executable by the processor to, responsive to detecting the audible or visual indicator of the emergency vehicle, estimate a location of the emergency vehicle based on one or more parameters of the audible or visual indicator, present an alert when the estimated location of the emergency vehicle is within an actionable region relative to the first vehicle, the alert including an indication of the estimated location of the emergency vehicle, and present no alert or a reduced alert when the estimated location of the emergency vehicle is not within the actionable region.

16 Claims, 7 Drawing Sheets

(56) References Cited

OTHER PUBLICATIONS

Sivaraman, S. et al., "Looking at Vehicles on the Road: A Survey of Vision-Based Vehicle Detection, Tracking, and Behavior Analysis," IEEE Transactions on Intelligent Transportation Systems, vol. 14, No. 4, Dec. 2013, available online Jul. 18, 2013, 23 pages.
Huang, P. et al., "Joint Optimization of Masks and Deep Recurrent Neural Networks for Monaural Source Separation," IEEE/ACM Transactions on Audio, Speech, and Language Processing, vol. 23, No. 12, Dec. 2015, available online Aug. 13, 2015, 12 pages.

* cited by examiner

EMERGENCY VEHICLE ALERT SYSTEM

FIELD

The disclosure relates to locating and providing alerts relating to emergency vehicles and/or sirens in a vicinity of a vehicle.

BACKGROUND

Vehicles may be equipped with navigation systems that assist a user in traversing roadways to reach a destination. Such navigation systems may include components for locating a user, a destination, and a connected network of roadways therebetween via a global positioning system (GPS). Some navigation systems may include or have access to traffic monitoring systems that provide navigation instructions factoring in estimated (e.g., average) or near-real-time traffic conditions.

A vehicle may encounter other conditions during travel that are not recognized by typical navigation systems. For example, civilian vehicles (e.g., non-emergency-related vehicles) may be obliged, either by custom or by law, to move out of a way of emergency vehicles, such as ambulances, police vehicles, fire engines, etc. In order to alert surrounding vehicles, emergency vehicles may be equipped with audio and visual indicators (e.g., flashing/strobing lights, reflective indicators, sirens, etc.). In many cases, a driver may hear the emergency vehicle before seeing the emergency vehicle.

SUMMARY

In the above example, in which a driver hears the emergency vehicle before seeing the emergency vehicle, the driver may shift focus away from the road and/or direction of travel of his/her vehicle in order to attempt to locate the emergency vehicle. Additionally or alternatively, the driver may pre-emptively pull over to a side of a road, even if his/her vehicle is not in the path of the emergency vehicle. In either case, the driver may be distracted and navigation of the driver's vehicle may be unnecessarily disrupted due to the presence of the emergency vehicle in the vicinity of the driver's vehicle. In still other examples, due to the presence of vehicle and/or environmental noise, the driver may not hear or see an approaching emergency vehicle. In such a scenario, the driver may disrupt the travel of the emergency vehicle by not immediately moving out of the path of travel of the emergency vehicle.

Embodiments are disclosed for locating an emergency vehicle in a vicinity of a vehicle and outputting, to a driver of the vehicle, an indication of the location of the emergency vehicle and/or an indication as to whether the vehicle is in the path of the emergency vehicle. The embodiments of the present disclosure may thereby assist a driver in deciding a course of action after being alerted as to the presence and/or location of the emergency vehicle. In a first example, an in-vehicle computing system of a first vehicle includes an alert output device, a sensor subsystem communicatively coupled to one or more of an audio sensor and an image sensor, a processor, and a storage device storing instructions executable by the processor to monitor one or both of audio output from the audio sensor and image output from the image sensor, detect an audible or visual indicator of an emergency vehicle, and, responsive to detecting the audible or visual indicator of the emergency vehicle, estimate a location of the emergency vehicle based on one or more parameters of the audible or visual indicator, present, via the alert output device, an alert when the estimated location of the emergency vehicle is within an actionable region relative to the first vehicle, the alert including an indication of the estimated location of the emergency vehicle, and present, via the alert output device, no alert or a reduced alert when the estimated location of the emergency vehicle is not within the actionable region.

Embodiments are also disclosed for a method of locating an emergency vehicle in proximity to a first vehicle, the method including monitoring audio output from at least one audio sensor of the first vehicle and image output from at least one image sensor of the first vehicle, detecting one or more of an audible indicator and a visual indicator of an emergency vehicle, and, responsive to detecting the audible indicator of the emergency vehicle, determining a first estimated location of the emergency vehicle based on one or more parameters of the audible indicator, responsive to detecting the visual indicator of the emergency vehicle, determining a second estimated location of the emergency vehicle based on one or more parameters of the visual indicator, responsive to detecting the audio indicator and the visual indicator of the emergency vehicle, determining an updated location of the emergency vehicle based on the first estimated location and the second estimated location, and selectively presenting, via an alert output device of the first vehicle, an alert based on the updated location of the emergency vehicle, the alert including an indication of the updated location of the emergency vehicle.

Embodiments are also disclosed for an in-vehicle computing system including an alert output device, a sensor subsystem communicatively coupled to one or more of an audio sensor and an image sensor, a processor, and a storage device storing instructions executable by the processor to monitor audio output from the audio sensor, detect an audible indicator of an emergency vehicle based on the audio output, responsive to detecting the audible indicator of the emergency vehicle determine a first estimated location of the emergency vehicle based on one or more parameters of the audible indicator, monitor image output from the image sensor, responsive to not detecting any visual indicator of the emergency vehicle based on the image output, selectively present, via the alert output device, a first alert based on the first estimated location of the emergency vehicle, the first alert including an indication of the first estimated location of the emergency vehicle, and, responsive to detecting a visual indicator of the emergency vehicle based on the image output determine a second estimated location of the emergency vehicle based on one or more parameters of the image output, adjust the first estimated location based on the second estimated location to generate an updated location of the emergency vehicle, and selectively present, via the alert output device, a second alert based on the updated location of the emergency vehicle, the second alert including an indication of the updated location of the emergency vehicle.

BRIEF DESCRIPTION OF THE DRAWINGS

The disclosure may be better understood from reading the following description of non-limiting embodiments, with reference to the attached drawings, wherein below.

DETAILED DESCRIPTION

A vehicle that includes a navigation system or other in-vehicle computing system may assist a driver in traversing roadways and operating the vehicle. However, even in the presence of such navigation systems and in-vehicle computing systems, drivers are still faced with reacting to dynamic conditions on the road. Some of these conditions may distract the driver from other vehicle operating duties by diverting attention away from the direction of travel and/or the immediately surrounding vehicles. One example of such a condition includes the presence of an emergency vehicle within a vicinity of the vehicle (e.g., within visual or audible range of the driver and/or sensors of the vehicle and/or along an intersecting path of the vehicle). Due to the urgent nature of emergency vehicle travel, drivers who hear associated sirens or other indicators of emergency vehicles may immediately react by attempting to locate the emergency vehicle. However, in the presence of heavy traffic, winding/intersecting roads, and/or other obstacles, the drivers may not be able to quickly locate the emergency vehicle or otherwise determine whether they are in the path of the emergency vehicle. Such difficulty in locating the emergency vehicle may lead to extended periods of time where the drivers are distracted from controlling their associated vehicles.

In order to relieve this distraction, and, in some cases, even provide advanced warning of emergency vehicles that a driver has not yet seen/heard, the disclosure provides methods and systems for a first vehicle to automatically locate a second, emergency vehicle using sensors of the first vehicle. The methods and systems of the present disclosure also provide for outputting an indication of the location of the emergency vehicle and/or an indication of a course of action for the first vehicle to take in light of the location and trajectory of the emergency vehicle. Examples are provided below for emergency vehicle detection and location mechanisms, and for mechanisms of indicating the location of the emergency vehicle and/or course of action responsive to the emergency vehicle.

Figure 1:
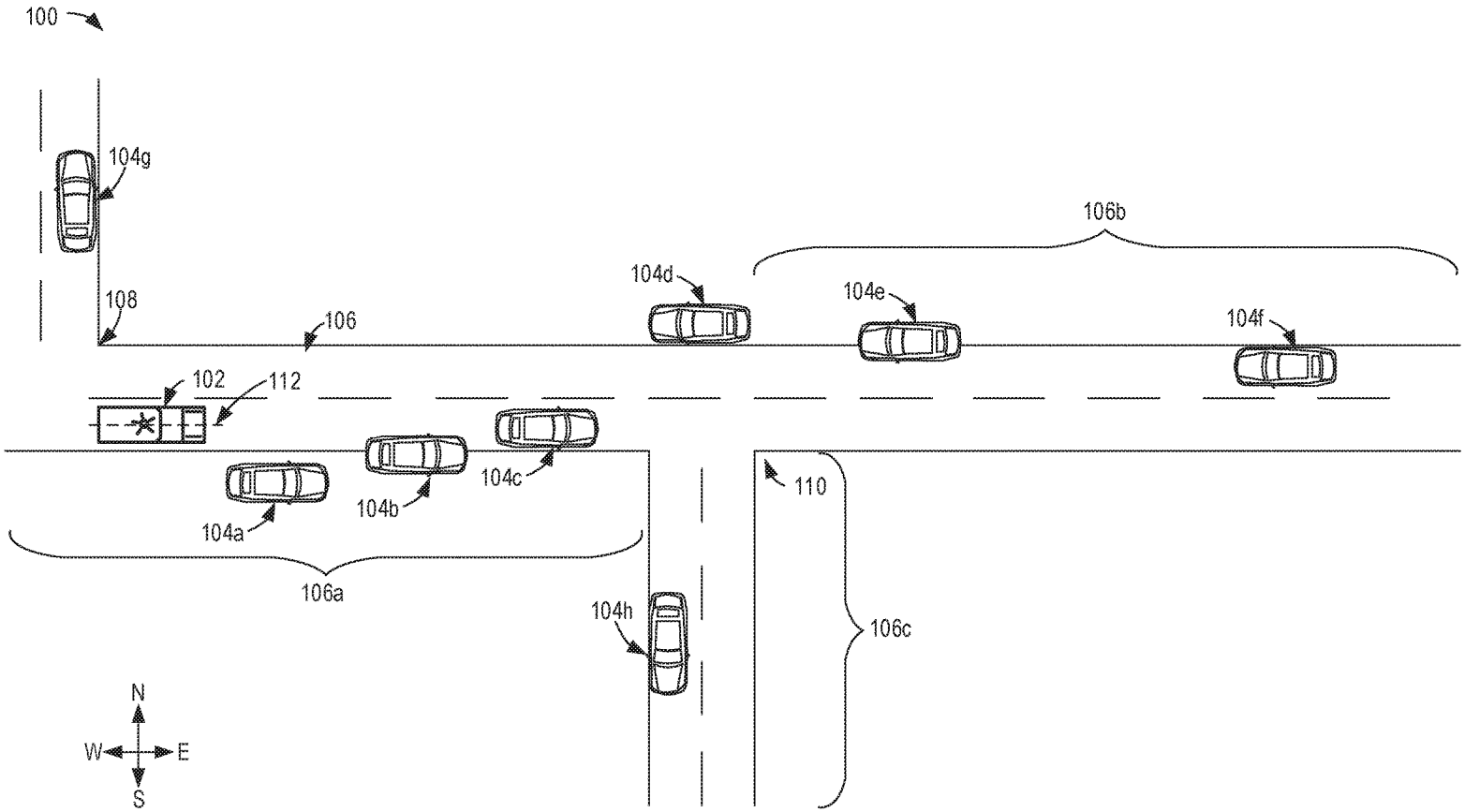
FIG. 1 shows an example road environment including an emergency vehicle in accordance with one or more embodiments of the present disclosure.

FIG. 1 schematically shows an example driving environment 100 including an emergency vehicle 102 and a plurality of other (e.g., non-emergency, civilian) vehicles 104*a*-104*h* located approximately on roadway 106. In the illustrated example, roadway 106 is a two-lane highway, where emergency vehicle 102 and vehicles 104*a*, 104*b*, and 104*c* are traveling (or are facing) east, vehicles 104*d*, 104*e*, and 104*f* are traveling (or are facing) west, vehicle 104*g* has turned at an intersection 108 of roadway 106 and is traveling north, and vehicle 104*h* has turned at an intersection 110 of roadway 106 and is traveling south. The trajectory of the emergency vehicle may correspond to a heading of the emergency vehicle (e.g., a direction of travel of the emergency vehicle assuming that the emergency vehicle is driving forward) and may extend in parallel or coaxially with a longitudinal axis 112 of the emergency vehicle. In some examples, the trajectory of the emergency vehicle may be mapped according to the roadway on which the emergency vehicle is traveling when detected by another vehicle. For example, the trajectory of the emergency vehicle 102 may include traversing roadway 106 west to east until the intersection 110 (e.g., along section 106*a* of the roadway), and then either traversing roadway 106 east to west after the intersection 110 (e.g., along section 106*b* of the roadway) or turning to traverse the roadway north to south after the intersection 110 (e.g., along section 106*c* of the roadway).

In light of this trajectory of emergency vehicle 102, each of the vehicles 104*a*-104*f* and vehicle 104*h* may benefit from an alert to indicate that the emergency vehicle is heading toward the respective vehicle. In the illustrated example, only vehicle 104*g* may not be in a location that warrants potentially moving for the emergency vehicle. However, vehicle 104*g* may also benefit from an alert regarding the emergency vehicle since the emergency vehicle may be heard by a driver of vehicle 104*g* but may not be seen by the driver. Accordingly, an alert to indicate that the emergency vehicle is heading away from the vehicle 104*g* may be helpful in reducing the cognitive load of the driver of vehicle 104*g*. Likewise, vehicle 104*h* may benefit from an alert that shows a dynamically updated location of the emergency vehicle, so that the driver of vehicle 104*h* may stay informed as to whether the emergency vehicle continues straight through intersection 110 (away from vehicle 104*h*) or turns south at the intersection 110 (toward vehicle 104*h*).

The methods described with respect to FIGS. 2-5 may be performed to automatically locate an emergency vehicle, such as emergency vehicle 102, and selectively present an alert indicating the location of the emergency vehicle and/or a suggestion as to an action to take responsive to the location and/or trajectory of the emergency vehicle. An example suggestion for the driver of vehicle 104*c* may include "pull over for emergency vehicle," whereas an example suggestion for the driver of vehicle 104*h* may include "continue driving and/or monitoring the location of the emergency vehicle" and/or another suggestion relating to maintaining a speed and/or staying within a current lane of a roadway on which the vehicle is traveling. In some examples, the suggestion may override outputs from other applications. For example, a navigation application outputting directions for traveling to a selected destination may be overridden such that the suggestion is presented instead of the directions (e.g., even if the suggestion conflicts with the direction).

Figure 2:
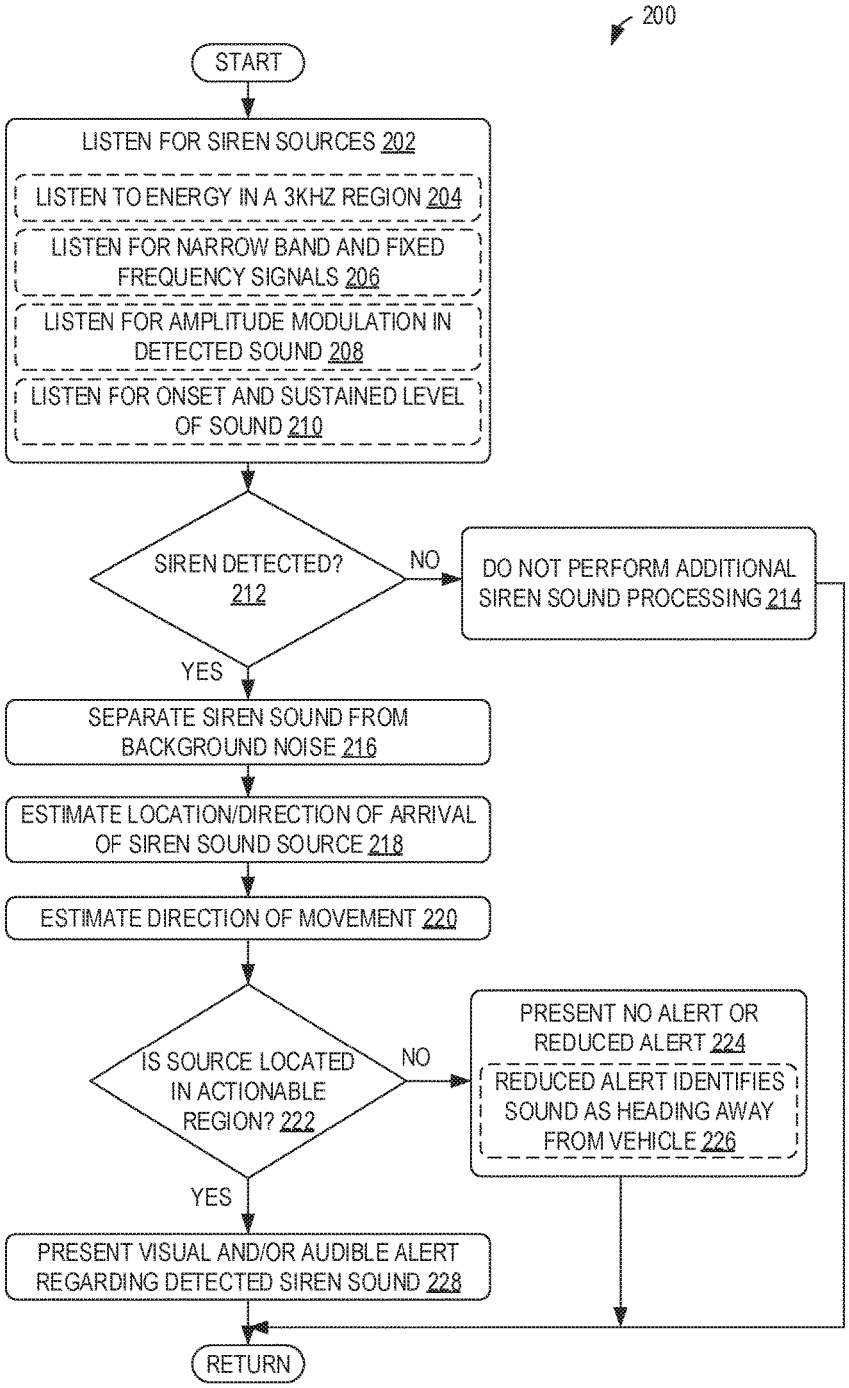
FIG. 2 shows a flow chart of an example method for locating an emergency vehicle using audible indicators in accordance with one or more embodiments of the present disclosure.

FIG. 2 shows a flow chart of an example method 200 for locating an emergency vehicle using audible indicators. Method 200 may be performed by an in-vehicle computing system using signals from one or more vehicle sensors and/or other sensors in communication with the in-vehicle computing system. In additional or alternative examples, one or more portions of method 200 may be performed off-board of a vehicle via a cloud computing device or other remote extra-vehicle computing device (e.g., spatially separated from the vehicle and/or in-vehicle computing system and in communication with the in-vehicle computing system via a wired or wireless communication link), rather than on-board the vehicle via the in-vehicle computing system. In still other additional or alternative examples, one or more portions of method 200 may be performed with a mobile computing device, such as a smartphone, tablet computer, or laptop computer, located in the vehicle.

At 202, method 200 includes listening for siren sources. One or more audio sensors (e.g., microphones) that are vehicle-mounted (e.g., on an exterior or interior of the vehicle), vehicle-integrated, or vehicle-related (e.g., audio sensors integrated or mounted on devices within the vehicle, such as a mobile computing device, or outside the vehicle but in communication with the in-vehicle computing system) may be used to detect sounds indicative of siren sources. Accordingly, listening for siren sources may include capturing audio signals from the vehicle audio sensors and processing the audio signals to determine associated parameters. Examples of parameters that may be determined to detect a siren are described below.

As indicated at 204, the siren sources may be detected by listening to energy in a 3 kHz region of an audio band (e.g., energy within a threshold frequency of 3 kHz, where the threshold is ±1 kHz in one example). Energy at 3 kHz may be associated with typical sirens used by emergency vehicles and may not be associated with commonly-experienced environmental sounds. Accordingly, the presence of energy in the 3 kHz region and/or the presence of energy having at least a threshold amplitude or other parameter may indicate that a siren is detected.

As indicated at 206, listening for siren sources may additionally or alternatively include listening for narrow band and fixed frequency signals. For example, siren sounds may include sound within a narrow frequency band that maintains a constant frequency for a period of time. Accordingly, listening for siren sources may include detecting sound that meets the above-described parameters. Listening for siren sources may additionally or alternatively include listening for amplitude modulation (e.g., an amplitude modulation pattern that matches a predetermined amplitude modulation pattern associated with siren sounds) in sound detected by the one or more audio sensors, as indicated at 208, and/or listening for an onset (e.g., transitioning from no sound at a given frequency or sound below a threshold amplitude at the given frequency to any sound or any sound above the threshold amplitude at the given frequency) and sustained level of sound (e.g., at any frequency or at a range of frequencies equaling or within the frequency range that is detectable by human hearing [20 Hz to 20 kHz]), as indicated at 210. In each of these cases, detected audio may be compared to sound qualities associated with a siren sound (e.g., a pattern and/or frequency of sound), such that detected sound that matches a parameter of sound associated with siren sounds may be determined to be a siren.

At 212, the method includes determining whether a siren is detected (e.g., by using any combination of one or more of the actions performed at 204 through 210, described above). When no siren is detected (e.g., if no sound is detected in the 3 kHz region, no narrow band or fixed frequency signals are detected, no sound having amplitude modulation that matches a predetermined pattern is detected, no sound that has an onset and sustained level is detected, or otherwise "NO" at 212), the method includes not performing additional siren sound processing, as indicated at 214, and returns to continue monitoring for siren sources (e.g., returns to 202).

When a siren is detected (e.g., "YES" at 212, where a sound is detected in the 3 kHz region, narrow band or fixed frequency signals are detected, sound having amplitude modulation that matches a predetermined pattern is detected, sound that has an onset and sustained level is detected, etc.), the method includes separating the siren sound from background noise at 216. For example, one or more separation algorithms may be applied and/or intelligent processing such as deep neural networks or other modeling processes may be used to separate siren sound from background noise. Example separation algorithms used to separate sound at 216 may include domain-specific approaches that utilize prior knowledge and parameters of the separation (e.g., knowing parameters of typical siren sounds and/or typical environmental sounds and applying filters to remove non-siren sounds and/or remove environmental sounds) and domain-agnostic approaches (e.g., applying non-negative matrix factorization and probabilistic latent semantic indexing to learn non-negative reconstruction bases and weights of different sources, which may be used to factorize time-frequency spectral representations of detected audio). One or more microphones associated with the vehicle may also continuously or regularly/periodically record background noise in an environment of the vehicle so that, upon detection of a siren sound, the background noise may be subtracted based on the previously (e.g., most recently) recorded noise (e.g., the known noise).

At 218, the method includes estimating a location and/or direction of arrival of the detected siren sound source. An example technique for estimating the location and/or direction of arrival includes beamforming, which uses an array of microphones and an alignment algorithm to evaluate parameters of the sound signal as detected (or not detected) by each microphone of the array. The array of microphones may be located in different regions of the vehicle, where the relative location of the microphones to the vehicle and/or to each other is known by the in-vehicle computing system or other processing device performing the beamforming. This known relative location may be used with the alignment algorithm to determine the direction of arrival of the siren sound, which may then be mapped using a current location of the vehicle as a reference point (e.g., and using an amplitude of the sound as a distance indicator) to determine an estimated location of the siren sound source. Example algorithms for estimating direction of arrival may include beamscan algorithms and subspace algorithms. Beamscan algorithms may form a conventional beam, scan it over a region, and plot the magnitude squared of output to establish features of an audio environment (e.g., in the case of minimum variance distortionless response [MVDR] and MVDR-root beamformers). Subspace algorithms may include a set of algorithms, where the orthogonality between the signal and noise subspaces is exploited (e.g., in the case of multiple signal classification [MUSIC], MUSIC-root, and estimation of signal parameters via rotational invariance techniques [ESPIRIT]). The location estimation may also include compensating for reverberations and echoes from nearby buildings.

At 220, the method includes estimating a direction of movement of the siren sound source. For example, the detected siren sound (e.g., as separated from background noise) may be detected over a period of time to determine changes in instantaneous location of the siren sound source (e.g., as estimated at 218). The changes in instantaneous location of the siren sound source may be compared to known paths of travel (e.g., roadways) in the location of the emergency vehicle in order to determine an estimated trajectory of the emergency vehicle.

At 222, the method includes determining if the siren sound source is located in an actionable region. An actionable region may include a region within a threshold distance of a vehicle and/or a region from which the siren sound source may travel (e.g., according to a database of roadways) in the determined direction of movement to reach the vehicle. Accordingly, the actionable region may include any region that indicates that the path of the emergency vehicle may intersect with the current location and/or path of the vehicle (e.g., as determined by a navigation application executed by the in-vehicle computing system and/or a current location and heading direction of the vehicle as determined by one or more geospatial location, motion, audio, and/or video sensors of the vehicle). It is to be understood that the determination at 222 may additionally or alternatively include determining whether the emergency vehicle is traveling toward the vehicle.

When the siren sound source is not located in an actionable region (and/or when the siren sound source is not traveling toward the vehicle or traveling on an intersecting path with the vehicle, e.g., "NO" at 222), the method includes presenting no alert or providing a reduced alert, as indicated at 224. A reduced alert may include an identification that the emergency vehicle is heading away from the vehicle, and may optionally include an estimated location of the emergency vehicle (static or dynamically updated for a threshold period of time), as indicated at 226.

When the siren sound source is located in the actionable region (and/or when the siren sound source is traveling toward the vehicle or traveling on an intersecting path with the vehicle, "YES" at 222), the method includes presenting a visual and/or audible alert regarding the detected siren sound via an alert output device, as indicated at 228. An example visual alert may include displaying a location of the emergency vehicle (e.g., on a map, shown relative to a location of the vehicle), displaying a text- and/or image-based alert in the vehicle (e.g., on an alert output device such as a display of the in-vehicle computing system and/or a mobile device in the vehicle) indicating the presence and location of the emergency vehicle (e.g., a text alert indicating that the emergency vehicle is located behind the vehicle or an arrow indicating a direction from which the emergency vehicle is arriving), adjusting a color, brightness/intensity, and/or other parameter of light from the display and/or from another alert output device such as one or more cabin lights (e.g., flashing the display red and blue), and/or otherwise adjusting a visual component of the vehicle.

The visual alert may additionally or alternatively include an indication of a suggested action for the driver (e.g., a suggestion to pull off). The suggested action may be based on a distance between the vehicle and the emergency vehicle, features of the roadway one which the vehicle is traversing, and/or a status of the vehicle. For example, the suggestion may include a suggestion to pull off after a next intersection or after a next curve when the emergency vehicle is estimated to be at a location that is more than a threshold distance from the vehicle (e.g., where the threshold is based on the distance between the vehicle and the next intersection). As another example, the suggestion may include a suggestion to pull off in the nearest region of roadway that includes a shoulder or to switch lanes based on a configuration of the roadway on which the vehicle is traveling. Roadway features such as emergency lanes, shoulders, curbs, sidewalks, crosswalks, guardrails, intersections, curves, number/size/type (e.g., turning, carpool/high occupancy vehicle, bus/public transit, etc.) of lanes, roadway construction material (e.g., dirt, gravel, asphalt), grading, etc. may be evaluated to provide recommendations for accommodating locations to which the vehicle may move in order to avoid interfering with the emergency vehicle.

The example alerts described above may additionally or alternatively be provided as an audible alert. For example, an alert output device may include one or more speakers in the vehicle that may output an audible signal indicating the location of the emergency vehicle and/or a suggestion for avoiding emergency vehicle interference. An example audible alert include a speech-based alert that states the above-described information. In other examples, different tones may be associated with different emergency vehicle statuses (e.g., a tone that increases in volume and/or frequency as the emergency vehicle nears the vehicle, and decreases in volume and/or frequency as the emergency vehicle travels away from the vehicle). In either example, the alert may be presented in a directional manner, such that the alert appears to the driver as originating from a location corresponding to the location of the emergency vehicle relative to the vehicle (e.g., outputting the alert from one or more front speakers when the emergency vehicle is located toward a front of the vehicle and outputting the alert from one or more rear speakers when the emergency vehicle is located toward a rear of the vehicle). Other types of alerts, such as haptic alerts (e.g., vibrating the steering wheel) may be provided in combination with the audio and visual alerts in order to secure the attention of the driver. Furthermore, in some examples, an alert may include and/or be accompanied by an automatic control of a vehicle operating device (e.g., a steering wheel/steering system, a braking system, a throttle, etc.) to effect an emergency vehicle avoidance maneuver. In such examples, automatic control of the vehicle may only be performed when the driver has indicated a user preference for such control. In other examples, an alert may include and/or be accompanied by a reduction in automatic control of a vehicle operating device to enable a driver to take over control of the vehicle in order to avoid the emergency vehicle. For example, if the vehicle is operating in an autonomous or semi-autonomous operating mode (e.g., steering and drive inputs to the vehicle being generated independent of an operator, but with an operator present, and based on sensed data and vehicle communications), the system may terminate the autonomous and/or semi-autonomous operating mode and return control of the vehicle (e.g., steering and drive inputs (acceleration and/or braking)) to follow operator commands in response to detection of an emergency vehicle within a threshold of the current location of the vehicle, and/or responsive to the location of the detected emergency vehicle being behind, and not ahead, of the current vehicle. A notification may also be generated to the operator current with this transition signaling the termination of the autonomous and/or semi-autonomous operating mode to signal the operator to take control or that their inputs are now in control of the vehicle motion.

It is to be understood that providing the visual and/or audible alert at 228 may include maintaining an alert state or transitioning from a non-alert state (e.g., where no alert or a reduced alert relating to the emergency vehicle is presented, as described at 224/226) to an alert state (e.g., where an alert relating to the emergency vehicle is presented, as described at 228). In examples where the alert state is transitioned from the non-alert state to the alert state, the associated output devices (e.g., display, speakers, etc.) may be transitioned from an off state to an on state and/or may be adjusted to display/output different and/or additional information relative to the non-alert state. Furthermore, the alert presented at 228 may change dynamically as the emergency vehicle is tracked. For example, the alert may be presented as long as the emergency vehicle is in the actionable region, but may change as the emergency vehicle moves closer or farther away. The presentation of no alert or a reduced alert at 224 may include maintaining a non-alert state or transitioning from an alert state to a non-alert state (e.g., responsive to the emergency vehicle and/or vehicle moving such that the emergency vehicle is no longer in the actionable region). In examples where the state is changed from alert to non-alert, the associated output devices for the alert may be transitioned from an on state to an off state and/or may be adjusted to display/output different and/or less information relative to the alert state. For example, the display may return to displaying a last-used application and/or the speaker may return to outputting music that was output prior to the alert being presented.

Figure 3:
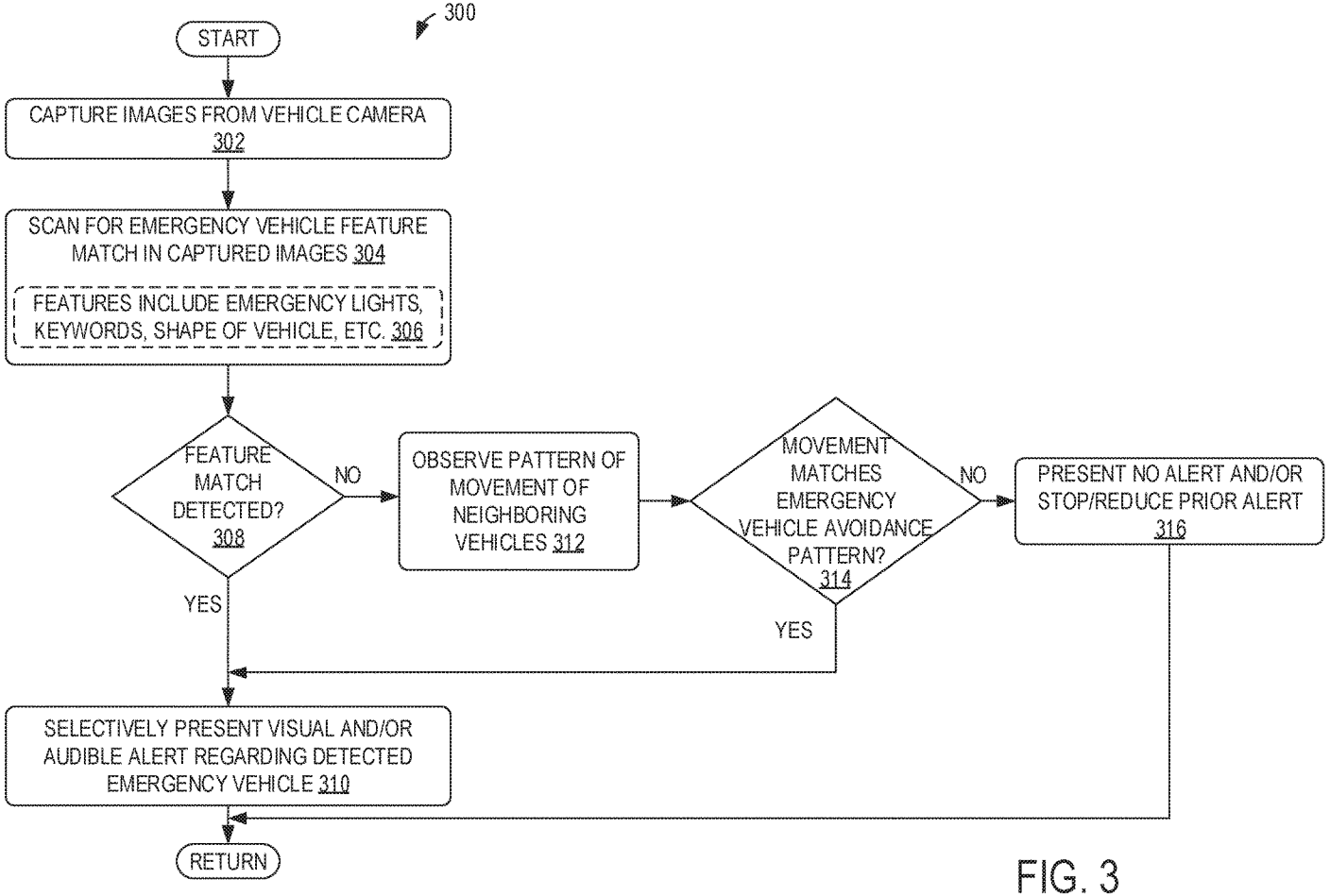
FIG. 3 shows a flow chart of an example method for locating an emergency vehicle using visual indicators in accordance with one or more embodiments of the present disclosure.

FIG. 3 shows a flow chart of an example method 300 for determining a presence and/or location of an emergency vehicle using visual indicators. Method 300 may be performed by the same and/or a different device(s) than those used to perform method 200 of FIG. 2. The example devices for performing method 300 include those described above with respect to the performance of method 200 of FIG. 2, and include an in-vehicle computing system (using signals from one or more vehicle sensors and/or other sensors in communication with the in-vehicle computing system), a cloud computing device or other remote extra-vehicle computing device, and/or a mobile computing device.

At 302, the method includes capturing images from a vehicle camera. The vehicle camera may include a backup camera mounted to a rear of the vehicle, one or more side cameras mounted on a side of the vehicle, and/or one or more front-facing cameras mounted on a front of the vehicle. At 304, the method includes scanning the captured images for emergency vehicle feature matches. As indicated at 306, features that may be matched in the images include emergency lights, keywords (e.g., "EMERGENCY" as written on an emergency vehicle), shape of a vehicle (e.g., matching shapes of ambulances, fire engines, police vehicles—including roof-mounted lights, etc.), color patterns/schemes, and/or other distinguishing features present on emergency vehicles.

Matching features in the image may include performing machine learning, edge detection, object recognition, and/or other image processing to compare features in the captured images with known emergency-related features. The known emergency-related features may be stored in a database that is local to and/or accessible by the in-vehicle computing system and/or other processing system performing the feature matching. Features in the images may be considered to be a match to a known emergency-related feature when an overlap between the given known and imaged feature is above a threshold (e.g., at least 70% of a given known feature is identified in the captured images) and/or when a confidence level output of a machine learning feature matching algorithm is above a threshold (e.g., the algorithm outputs an indication that a given imaged feature is at least 70% likely to be the associated known feature). In some examples, the threshold overlap and/or confidence level may be decreased when the visual analysis of FIG. 3 is performed after locating the emergency vehicle using the sound analysis of FIG. 2 (as will be described in more detail below with respect to FIG. 4) relative to when the visual analysis of FIG. 3 is performed alone without performing the sound analysis of FIG. 2. At 308, the method includes determining if a feature match is detected.

When a feature match is detected and/or when a threshold number of feature matches is detected (e.g., where the threshold number of feature matches decreases when combining the visual analysis with the sound analysis as described above and below with respect to FIG. 4), the method proceeds (e.g., according to the "YES" branch off of 308) to 310 to selectively present a visual and/or audible alert regarding the detected emergency vehicle. The visual and/or audible alert may be the same or different than any alerts provided responsive to performing method 200 of FIG. 2, however any of the example alerts and associated features described above with respect to the presentation at 228 of FIG. 2 may be used as the presentation at 310 of FIG. 3. The selective presentation of the alert may include presenting the alert when the images indicate that the emergency vehicle is in an actionable region and/or headed toward the vehicle (e.g., based on an orientation of the vehicle, a change in vehicle position in multiple images, etc.), as discussed above and at 222 and 228 of FIG. 2. The selective presentation of the alert may include not presenting the alert or presenting a reduced alert when the images indicate that the emergency vehicle is not in an actionable region and/or headed toward the vehicle (e.g., based on an orientation of the vehicle, a change in vehicle position in multiple images, etc.), as discussed above and at 222-226 of FIG. 2.

When a feature match is not detected and/or when the threshold number of feature matches is not detected, the method proceeds (e.g., according to the "NO" branch off of 308) to 312 to observe a pattern of movement of neighboring vehicles (e.g., trailing vehicles, leading vehicles, vehicles in front of or behind the vehicle but in a different lane/different heading direction than the vehicle, vehicles in a nearby intersection or associated intersecting road, etc.). At 314, the method includes determining if the observed movement of the neighboring vehicles matches an emergency vehicle avoidance pattern. For example, vehicles may pull off of a roadway and/or onto a shoulder or far lane in order to provide space for an emergency vehicle to travel without obstruction. Accordingly, an emergency vehicle avoidance pattern may include multiple vehicles in a same direction pulling off of the roadway, changing lanes, slowing down, etc. in a sequential manner. If the vehicle avoidance pattern is observed (e.g., "YES" at 314), the method includes selectively presenting the visual and/or audible alert at 310 as discussed above. The location of the emergency vehicle, when indicated in the alert, may be based on the observed emergency vehicle avoidance pattern. For example, if the vehicles in front of the driver are observed as pulling off of the roadway, with the farthest vehicle pulling off before nearer vehicles, the location of the emergency vehicle may be indicated as being in front of the vehicle. Likewise, if the vehicles in the rear of the driver are observed as pulling off of the roadway, the location of the emergency vehicle may be indicated as being behind the vehicle. The selective presentation of the alert may include presenting the alert when the emergency vehicle avoidance pattern indicates that the emergency vehicle is in an actionable region and/or headed toward the vehicle, as discussed above and at 222 and 228 of FIG. 2. The selective presentation of the alert may include not presenting the alert or presenting a reduced alert when the emergency vehicle avoidance pattern indicates that the emergency vehicle is not in an actionable region and/or headed toward the vehicle, as discussed above and at 222-226 of FIG. 2.

If the vehicle avoidance pattern is not observed (e.g., "NO" at 314), the method proceeds to 316 to present no alert or to stop/reduce a prior alert. For example, if an emergency vehicle was detected in a prior iteration of method 300, and was no longer detected in a current iteration of method 300, the alert generated in the prior iteration of method 300 may be ceased (e.g., transitioned from an on/alert state to an off/no alert state) or reduced (e.g., identifying the emergency vehicle as heading away from the vehicle). The disclosure provided above with respect to the no alert or reduced alert at 224/226 of FIG. 2 may also apply to the not provided alert or stopped/reduced alert of 316/318. The method returns after presenting the alert (at 310) or presenting no alert or stopping/reducing the alert (at 316) to continue capturing and monitoring images.

In some examples, resources from roadway and/or municipal infrastructure may be utilized to supplement or provide the above-described visual or audio analysis and/or to otherwise locate an emergency vehicle. For example, traffic cameras and/or road-side microphones near a vehicle may be used to image environments in order to scan for emergency vehicles. Information from emergency vehicle dispatch services may be used to determine a likely location and/or destination of an emergency vehicle. Information (e.g., sensed data such as audio and/or image data or location data for an emergency vehicle) from neighboring vehicles (e.g., neighboring a vehicle or an emergency vehicle) may be shared amongst one another in order to resolve a location of the emergency vehicle. The above-described examples may be used to provide a rough location of the emergency vehicle, which is then fine-tuned using the above-described audio analysis of FIG. 2 and/or video/image analysis of FIG. 3, and/or to confirm a location of the emergency vehicle determined by the audio and/or video/image analysis of FIGS. 2 and 3. In additional or alternative examples, the infrastructure resources may be used during associated portions of the audio and video/image analysis of FIGS. 2 and 3 (e.g., using traffic cameras to capture images at 302 of FIG. 3) in addition or alternative to vehicle-based sensors.

Figure 4:
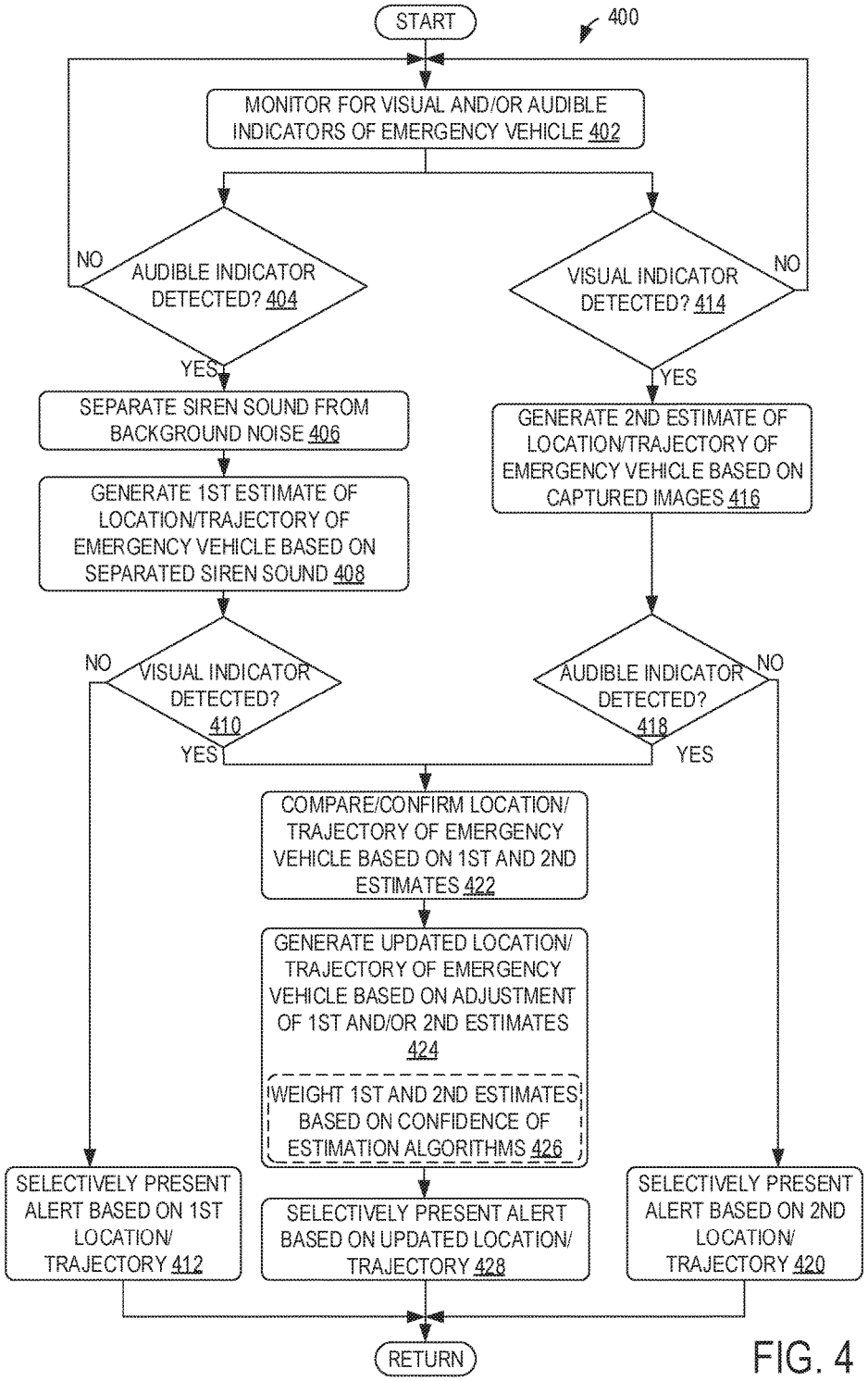
FIG. 4 shows a flow chart of an example method for locating an emergency vehicle using audible and/or visual indicators in accordance with one or more embodiments of the present disclosure.
Figure 5:
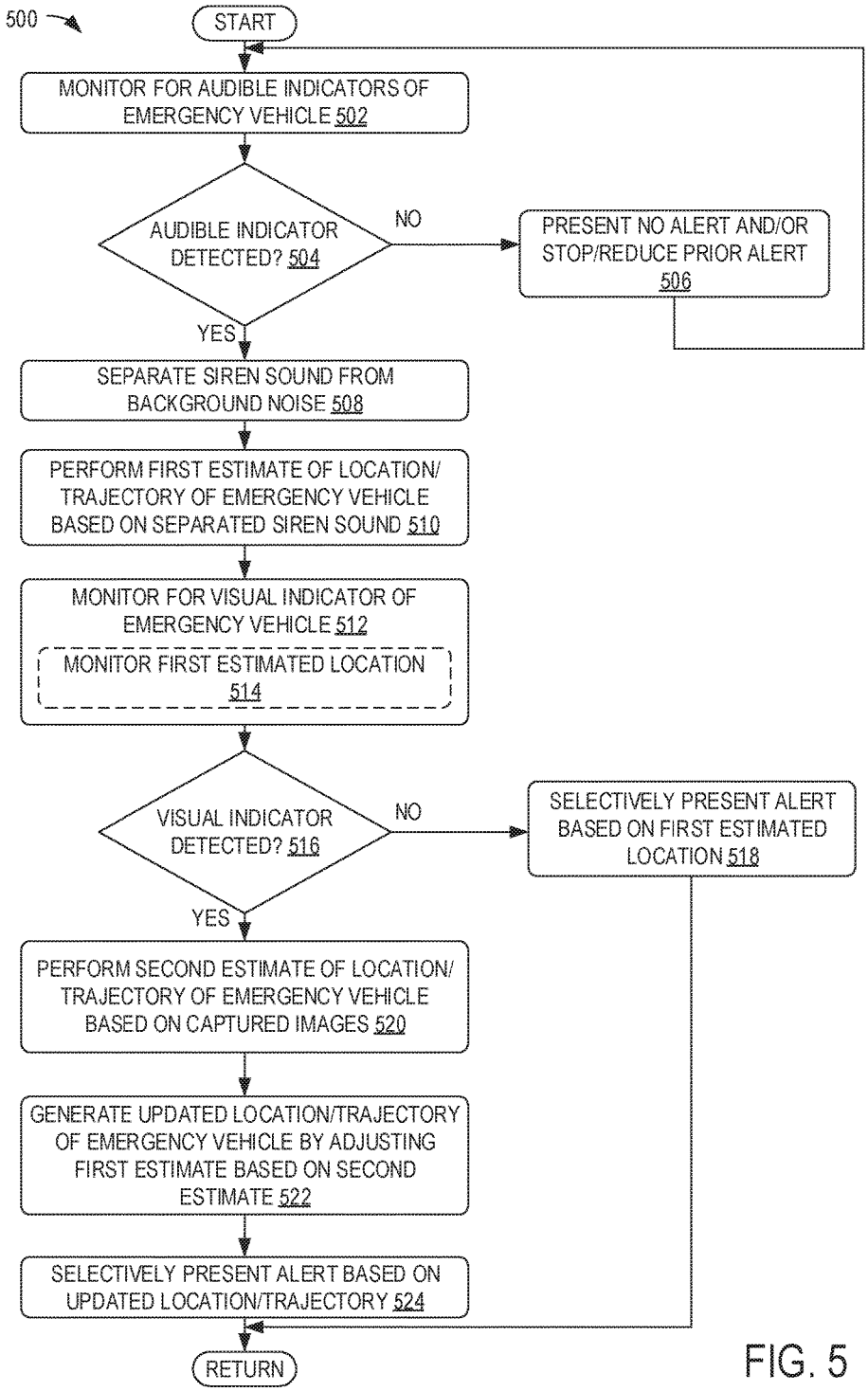
FIG. 5 shows a flow chart of an example method for locating an emergency vehicle using audible and/or visual indicators in accordance with one or more embodiments of the present disclosure.

As discussed briefly above, audible and visual processing may be combined in order to locate an emergency vehicle within range of detection of one or more sensors of a vehicle. FIGS. 4 and 5 show example methods for such combined processing. FIG. 4 shows a flow chart for an example method 400 of locating and alerting a driver to a presence of an emergency vehicle. Method 400 may be performed by the same and/or a different device(s) than those used to perform methods 200 and/or 300 of FIGS. 2 and 3. The example devices for performing method 400 include those described above with respect to the performance of method 200 of FIG. 2, and include an in-vehicle computing system (using signals from one or more vehicle sensors and/or other sensors in communication with the in-vehicle computing system), a cloud computing device or other remote extra-vehicle computing device, and/or a mobile computing device.

At 402, the method includes monitoring for visual and/or audible indicators of an emergency vehicle. Examples of monitoring for visual or audible indicators are described above and at 202-210 of FIGS. 2 and 302-308 and 312-314 of FIG. 3, respectively. At 404, the method includes determining if an audible indicator is detected. Examples of determining if an audible indicator is detected are described above and at 212 of FIG. 2. If an audible detector is not detected, the method continues monitoring for visual and/or audible indicators of an emergency vehicle (or continues along the visual indicator branch described below beginning at 414) without outputting an alert based on any audible indicator.

When an audible detector is detected (e.g., "YES" at 404), the method includes separating the siren from background noise, as indicated at 406 and described above and at 216 of FIG. 2, and generating a first estimate of a location and/or trajectory of the emergency vehicle based on the separated siren sound, as indicated at 408 (examples of such estimations are described above and at 218 and 220 of FIG. 2). In this audible indicator processing branch, the method includes, at 410, determining if a visual indicator is detected. If no visual indicator is detected (e.g., "NO" at 410), the method includes selectively presenting an alert based on the first location/trajectory estimation, as indicated at 412. The alert presented at 412 may only be based on the first location/trajectory estimation and/or may not be based on a visual indicator estimation of location/trajectory (e.g., generated as will be described below at 416).

The above-described elements of method 400, including the actions performed at 404-412, are included in an audible indictor processing branch of the method. The method further includes a visual indicator processing branch, including the actions at 414-420, which will be described below. The visual and audible indicator processing branches may be performed simultaneously (e.g., either synchronously or asynchronously) or sequentially in different examples of the method without departing from the scope of the disclosure. The audible indicator processing branch includes determining if a visual indicator of an emergency vehicle is detected at 414 (e.g., as described above and at 304-314 of FIG. 3). If no visual indicator is detected, the method returns to continue monitoring for visual and audible indicators of an emergency vehicle (or continues along the audible indicator branch described above beginning at 404) without outputting an alert based on any visual indicator.

When a visual indicator of an emergency vehicle is detected (e.g., "YES" at 414), the method includes, at 416, generating a second estimate of the location and/or trajectory of the emergency vehicle based on captured images indicating the emergency vehicle presence. For example, the first estimate of the location and/or trajectory may be based only on the audible siren sound, and/or may not be based on any visual indicator of an emergency vehicle. Similarly, the second estimate of the location and/or trajectory may be based only on the captured images, and/or may not be based on any audible indicator of an emergency vehicle. At 418, the method includes determining if an audible indicator is detected. If an audible indicator is not detected (e.g., "NO" at 418), the method includes selectively presenting an alert based on the second location/trajectory estimation, as indicated at 420. The alert presented at 420 may only be based on the second location/trajectory estimation and/or may not be based on an audible indicator estimation of location/trajectory (e.g., generated as described above at 408).

When both the visual indicator and audible indicator are detected (e.g., "YES" at 410 and 418), the method includes, at 422, comparing and/or confirming the location and/or trajectory of the emergency vehicle based on the first and second estimates. At 424, the method includes generating an updated location and/or trajectory of the emergency vehicle based on an adjustment of the first and/or second estimates of location/trajectory. As indicated at 426, the first and second estimates may be weighted based on a confidence of the estimation algorithms of each estimation generation routine and/or based on other factor(s) such as an environment of the vehicle (e.g., a number of visual obstructions versus audio obstructions).

At 428, the method includes selectively presenting an alert based on the updated location and/or trajectory of the emergency vehicle. For example, the alert may be selectively presented based on evaluating a location and/or trajectory of the emergency vehicle that is generated using information from both the audible indicator processing branch and the visual indicator processing branch of the method. The selective presentation of the alerts at 412, 420, and 428 may be performed as described above with respect to methods 200 and 300 of FIGS. 2 and 3 at 222-228 and 310-318, respectively. For example, the alert may be presented when the first, second, or updated location/trajectory (respectively) indicates that the emergency vehicle is in an actionable region (as described above with respect to 222 of FIG. 2). The alert may not be presented or a reduced alert may be presented when the first, second, or updated location/trajectory (respectively) indicates that the emergency vehicle is not in an actionable region.

FIG. 5 shows a flow chart for another example method 500 of locating and alerting a driver to a presence of an emergency vehicle. Method 500 may be performed by the same and/or a different device(s) than those used to perform methods 200, 300, and/or 400 of FIGS. 2-4. The example devices for performing method 500 include those described above with respect to the performance of method 200 of FIG. 2, and include an in-vehicle computing system (using signals from one or more vehicle sensors and/or other sensors in communication with the in-vehicle computing system), a cloud computing device or other remote extra-vehicle computing device, and/or a mobile computing device.

At 502, the method includes monitoring for audible indicators of an emergency vehicle. It is to be understood that portions of method 500 (such as the monitoring for audible indicators) that have been described above with respect to FIGS. 2-4 may be performed according to the associated description in FIGS. 2-4. At 504, the method includes determining if an audible indicator is detected. If no audible indicator is detected, the method includes presenting no alert or stopping/reducing a prior alert at 506. For example, if an emergency vehicle was detected in a prior iteration of method 500, and was no longer detected in a current iteration of method 500, the alert generated in the prior iteration of method 500 may be ceased (e.g., transitioned from an on/alert state to an off/no alert state) or reduced (e.g., identifying the emergency vehicle as heading away from the vehicle, if such a determination is made).

When an audible indicator is detected (e.g., "YES" at 504), the method includes separating a siren sound associated with the audible indicator from background noise, as indicated at 508. The method further includes performing a first estimate of a location and/or trajectory of the emergency vehicle based on the separated siren sound, as indicated at 510. The presence of the audible indicator may serve as a trigger to begin monitoring for a visual indicator of the emergency vehicle at 512 (e.g., to save computing resources, the visual monitoring may only be performed if the audible indicator is detected, since a siren sound is often able to be detected prior to visual detection of an emergency vehicle). As indicated at 514, in some examples, the first estimated location of the emergency vehicle (estimated at 510) may be monitored for visual indicators to confirm that the audible indicator is an emergency vehicle. In other examples, all regions within a field of view of one or more cameras of the vehicle may be monitored (or all regions may be monitored after determining that there are no visual indicators in the region of the estimated location derived from the audible indicator processing).

At 516, the method includes determining if a visual indicator is detected. If no visual indicator is detected (e.g., "NO" at 516), the method includes selectively presenting an alert based on the first estimated location, as indicated at 518. For example, the alert may be presented when the first location/trajectory indicates that the emergency vehicle is in an actionable region. The alert may not be presented or a reduced alert may be presented when the first location/trajectory indicates that the emergency vehicle is not in an actionable region. The method may then return to continue monitoring the audible indicator and to monitor for visual indicators.

When a visual indicator is detected (e.g., "YES" at 516), the method includes, at 520, performing a second estimate of a location and/or trajectory of the emergency vehicle based on captured images (e.g., captured during the monitoring at 512/514). At 522, the method includes generating an updated location and/or trajectory of the emergency vehicle by adjusting the first estimate based on the second estimate. For example, the second estimate may be used to fine tune the first estimate, such that the first estimate provides the region in which the emergency vehicle is located and the second estimate provides the location within that region of the emergency vehicle. At 524, the method includes selectively presenting an alert based on the updated location/trajectory. For example, the alert may be presented when the updated location/trajectory indicates that the emergency vehicle is in an actionable region. The alert may not be presented or a reduced alert may be presented when the updated location/trajectory indicates that the emergency vehicle is not in an actionable region. The method may then return to continue monitoring the audible indicators and/or visual indicators.

Automatically locating and selectively generating alerts regarding the presence of an emergency vehicle provides a technical effect of increasing capabilities of a navigation unit or other in-vehicle computing system to include reducing cognitive load on drivers in the presence of an emergency vehicle. The generation of an audible, visual, and/or other alert may also provide a technical effect of adjusting operation of associated audible, visual, and/or other output devices in the vehicle to present a perceivable output that assists a driver in his/her driving operation.

Figure 6:
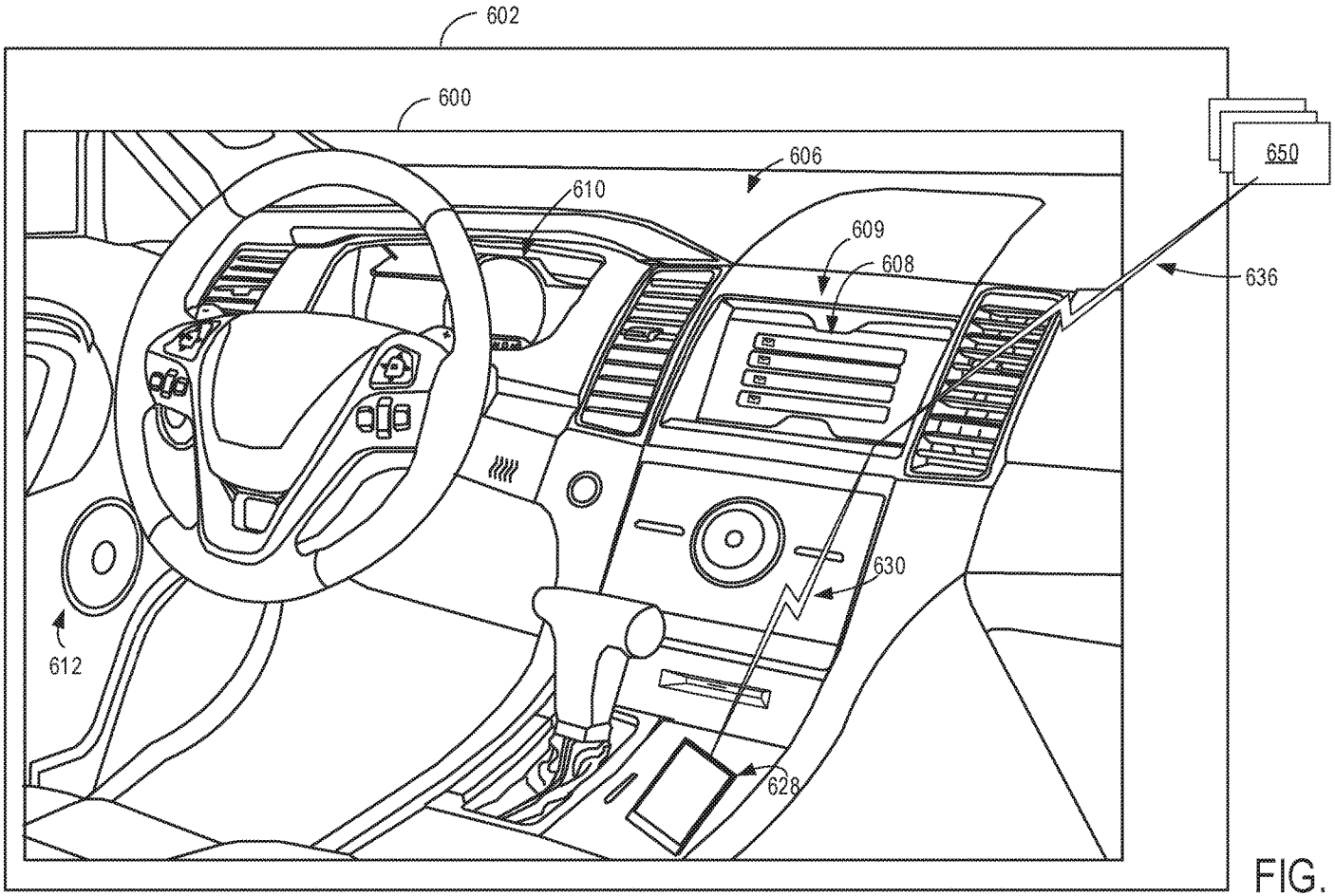
FIG. 6 shows an example partial view of a vehicle cabin in accordance with one or more embodiments of the present disclosure.

As described above, the described methods may be performed, at least in part, within a vehicle using an in-vehicle computing system as an emergency vehicle alert system. FIG. 6 shows an example partial view of one type of environment for an emergency vehicle alert system: an interior of a cabin 600 of a vehicle 602, in which a driver and/or one or more passengers may be seated. Vehicle 602 of FIG. 6 may include and/or be an example of any of vehicles 104*a*-104*h* of FIG. 1.

As shown, an instrument panel 606 may include various displays and controls accessible to a driver (also referred to as the user) of vehicle 602. For example, instrument panel 606 may include a touch screen 608 of an in-vehicle computing system 609 (e.g., an infotainment system), an audio system control panel, and an instrument cluster 610. While the example system shown in FIG. 6 includes audio system controls that may be performed via a user interface of in-vehicle computing system 609, such as touch screen 608 without a separate audio system control panel, in other embodiments, the vehicle may include an audio system control panel, which may include controls for a conventional vehicle audio system such as a radio, compact disc player, MP3 player, etc. The audio system controls may include features for controlling one or more aspects of audio output via speakers 612 of a vehicle speaker system. For example, the in-vehicle computing system or the audio system controls may control a volume of audio output, a distribution of sound among the individual speakers of the vehicle speaker system, an equalization of audio signals, and/or any other aspect of the audio output (e.g., to provide a directional alert, as described above). In further examples, in-vehicle computing system 609 may adjust a radio station selection, a playlist selection, a source of audio input (e.g., from radio or CD or MP3), etc., based on user input received directly via touch screen 608.

In some embodiments, one or more hardware elements of in-vehicle computing system 609, such as touch screen 608, a display screen, various control dials, knobs and buttons, memory, processor(s), and any interface elements (e.g., connectors or ports) may form an integrated head unit that is installed in instrument panel 606 of the vehicle. The head unit may be fixedly or removably attached in instrument panel 606. In additional or alternative embodiments, one or more hardware elements of the in-vehicle computing system may be modular and may be installed in multiple locations of the vehicle.

The cabin 600 may include one or more sensors for monitoring the vehicle, the user, and/or the environment. For example, the cabin 600 may include one or more microphones to receive user input in the form of voice commands and/or to measure ambient noise in the cabin 600 or outside of the vehicle (e.g., to establish a noise baseline for separating siren sounds from environmental noise and/or to detect a siren sound), etc. It is to be understood that the above-described sensors and/or one or more additional or alternative sensors may be positioned in any suitable location of the vehicle. For example, sensors may be positioned in an engine compartment, on an external surface of the vehicle, and/or in other suitable locations for providing information regarding the operation of the vehicle, ambient conditions of the vehicle, a user of the vehicle, etc. Information regarding ambient conditions of the vehicle, vehicle status, or vehicle driver may also be received from sensors external to/separate from the vehicle (that is, not part of the vehicle system), such as sensors coupled to external devices 650 and/or mobile device 628.

Cabin 600 may also include one or more user objects, such as mobile device 628, that are stored in the vehicle before, during, and/or after travelling. The mobile device 628 may include a smart phone, a tablet, a laptop computer, a portable media player, and/or any suitable mobile computing device. The mobile device 628 may be connected to the in-vehicle computing system via communication link 630. The communication link 630 may be wired (e.g., via Universal Serial Bus [USB], Mobile High-Definition Link [MHL], High-Definition Multimedia Interface [HDMI], Ethernet, etc.) or wireless (e.g., via BLUETOOTH, WIFI, WIFI direct Near-Field Communication [NFC], cellular connectivity, etc.) and configured to provide two-way communication between the mobile device and the in-vehicle computing system. The mobile device 628 may include one or more wireless communication interfaces for connecting to one or more communication links (e.g., one or more of the example communication links described above). The wireless communication interface may include one or more physical devices, such as antenna(s) or port(s) coupled to data lines for carrying transmitted or received data, as well as one or more modules/drivers for operating the physical devices in accordance with other devices in the mobile device. For example, the communication link 630 may provide sensor and/or control signals from various vehicle systems (such as vehicle audio system, sensor subsystem, etc.) and the touch screen 608 to the mobile device 628 and may provide control and/or display signals from the mobile device 628 to the in-vehicle systems and the touch screen 608. The communication link 630 may also provide power to the mobile device 628 from an in-vehicle power source in order to charge an internal battery of the mobile device.

In-vehicle computing system 609 may also be communicatively coupled to additional devices operated and/or accessed by the user but located external to vehicle 602, such as one or more external devices 650. In the depicted embodiment, external devices are located outside of vehicle 602 though it will be appreciated that in alternate embodiments, external devices may be located inside cabin 600. The external devices may include a server computing system, personal computing system, portable electronic device, electronic wrist band, electronic head band, portable music player, electronic activity tracking device, pedometer, smartwatch, GPS system, etc. External devices 650 may be connected to the in-vehicle computing system via communication link 636 which may be wired or wireless, as discussed with reference to communication link 630, and configured to provide two-way communication between the external devices and the in-vehicle computing system. For example, external devices 650 may include one or more sensors and communication link 636 may transmit sensor output from external devices 650 to in-vehicle computing system 609 and touch screen 608. External devices 650 may also store and/or receive information regarding navigational map data, image feature mapping data, etc. and may transmit such information from the external devices 650 to in-vehicle computing system 609 and/or touch screen 608. For example, an external device 650 may execute an application that includes or has access to information on emergency vehicles (e.g., locations, identifying details, sensed data from other vehicles that detected the emergency vehicles, etc.). In such an example, the external device may pass the information on the emergency vehicles to the in-vehicle computing system and/or other processing device to be used in the execution of any of the above-described methods.

In-vehicle computing system 609 may analyze the input received from external devices 650, mobile device 628, and/or other input sources and provide output via touch screen 608 and/or speakers 612, communicate with mobile device 628 and/or external devices 650, and/or perform other actions based on the assessment. In some embodiments, all or a portion of the assessment may be performed by the mobile device 628 and/or the external devices 650. In some embodiments, the external devices 650 may include in-vehicle computing devices of another vehicle.

In some embodiments, one or more of the external devices 650 may be communicatively coupled to in-vehicle computing system 609 indirectly, via mobile device 628 and/or another of the external devices 650. For example, communication link 636 may communicatively couple external devices 650 to mobile device 628 such that output from external devices 650 is relayed to mobile device 628. Data received from external devices 650 may then be aggregated at mobile device 628 with data collected by mobile device 628, the aggregated data then transmitted to in-vehicle computing system 609 and touch screen 608 via communication link 630. Similar data aggregation may occur at a server system and then transmitted to in-vehicle computing system 609 and touch screen 608 via communication link 636/630.

Figure 7:
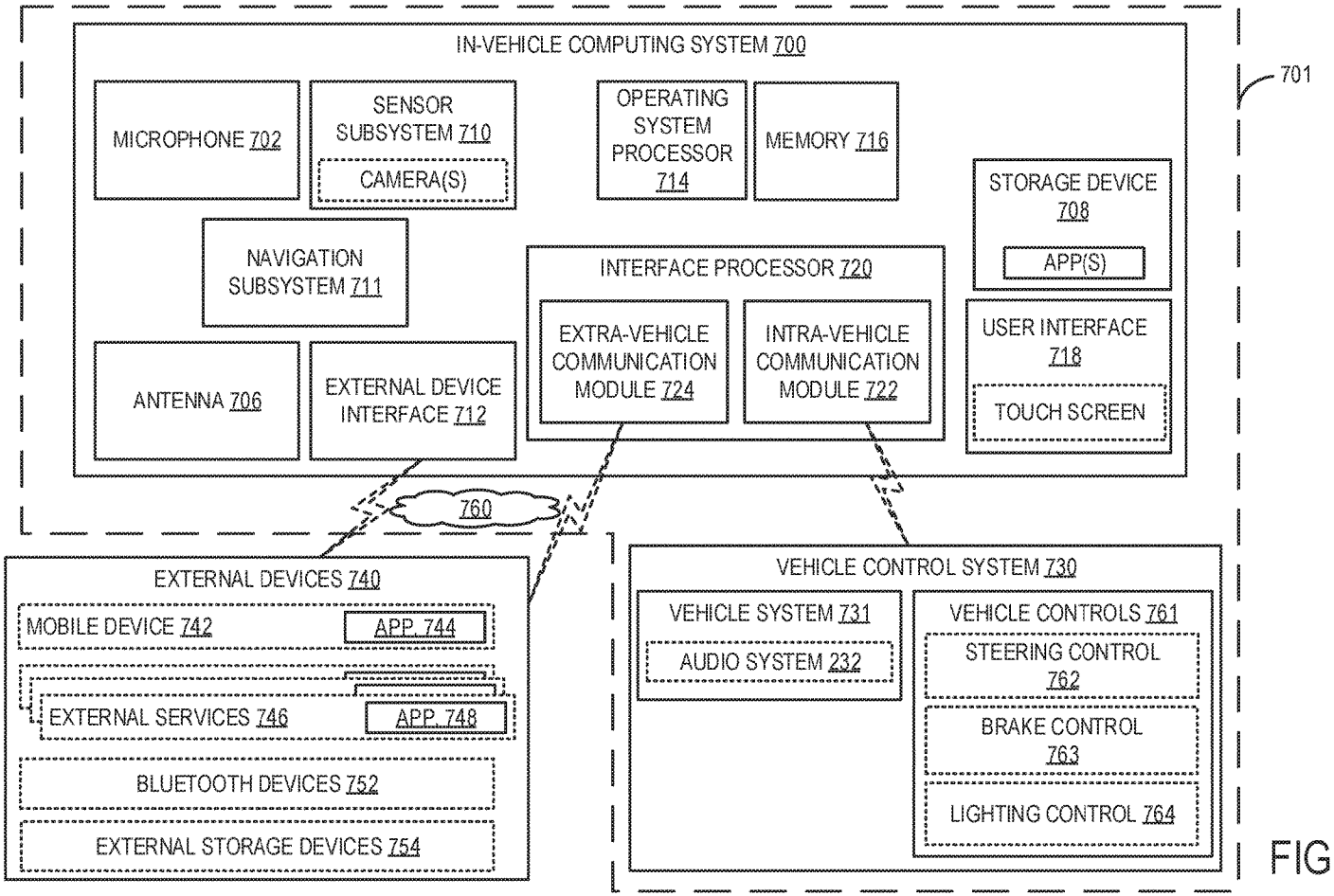
FIG. 7 shows a block diagram of an in-vehicle computing system in accordance with one or more embodiments of the present disclosure.

FIG. 7 shows a block diagram of an in-vehicle computing system 700 configured and/or integrated inside vehicle 701. In-vehicle computing system 700 may be an example of in-vehicle computing system 609 of FIG. 6 and/or may perform one or more of the methods described herein in some embodiments. In some examples, the in-vehicle computing system may be a vehicle infotainment system configured to provide information-based media content (audio and/or visual media content, including entertainment content, navigational services, etc.) to a vehicle user to enhance the operator's in-vehicle experience. The vehicle infotainment system may include, or be coupled to, various vehicle systems, sub-systems, hardware components, as well as software applications and systems that are integrated in, or integratable into, vehicle 701 in order to enhance an in-vehicle experience for a driver and/or a passenger.

In-vehicle computing system 700 may include one or more processors including an operating system processor 714 and an interface processor 720. Operating system processor 714 may execute an operating system on the in-vehicle computing system, and control input/output, display, playback, and other operations of the in-vehicle computing system. Interface processor 720 may interface with a vehicle control system 730 via an intra-vehicle communication module 722.

Intra-vehicle communication module 722 may output data to other vehicle systems 731 and vehicle control elements 761, while also receiving data input from other vehicle components and systems 731, 761, e.g. by way of vehicle control system 730. When outputting data, intra-vehicle communication module 722 may provide a signal via a bus corresponding to any status of the vehicle, the vehicle surroundings (e.g., as measured by one or more microphones or cameras mounted on the vehicle), or the output of any other information source connected to the vehicle. Vehicle data outputs may include, for example, analog signals (such as current velocity), digital signals provided by individual information sources (such as clocks, thermometers, location sensors such as Global Positioning System [GPS] sensors, etc.), and digital signals propagated through vehicle data networks (such as an engine controller area network [CAN] bus through which engine related information may be communicated and/or an audio-video bridging [AVB] network through which vehicle information may be communicated). For example, the in-vehicle computing system may retrieve from the engine CAN bus the current speed of the vehicle estimated by the wheel sensors, a current location of the vehicle provided by the GPS sensors, and a current trajectory of the vehicle provided by one or more inertial measurement sensors in order to determine an estimated path of the vehicle (e.g., to determine a likelihood of the vehicle intersecting with an emergency vehicle). In addition, other interfacing means such as Ethernet may be used as well without departing from the scope of this disclosure.

A non-volatile storage device 708 may be included in in-vehicle computing system 700 to store data such as instructions executable by processors 714 and 720 in non-volatile form. The storage device 708 may store application data to enable the in-vehicle computing system 700 to perform any of the above-described methods and/or to run an application for connecting to a cloud-based server and/or collecting information for transmission to the cloud-based server. Connection to a cloud-based server may be mediated via extra-vehicle communication module 724. The application may retrieve information gathered by vehicle systems/sensors, input devices (e.g., user interface 718), devices in communication with the in-vehicle computing system (e.g., a mobile device connected via a Bluetooth link), etc. In-vehicle computing system 700 may further include a volatile memory 716. Volatile memory 716 may be random access memory (RAM). Non-transitory storage devices, such as non-volatile storage device 708 and/or volatile memory 716, may store instructions and/or code that, when executed by a processor (e.g., operating system processor 714 and/or interface processor 720), controls the in-vehicle computing system 700 to perform one or more of the actions described in the disclosure.

A microphone 702 may be included in the in-vehicle computing system 700 to measure ambient noise in the vehicle, to measure ambient noise outside the vehicle, etc. One or more additional sensors may be included in and/or communicatively coupled to a sensor subsystem 710 of the in-vehicle computing system 700. For example, the sensor subsystem 710 may include and/or be communicatively coupled to a camera, such as a rear view camera for assisting a user in parking the vehicle, a cabin camera for identifying a user, and/or a front view camera to assess quality of the route segment ahead. The above-described cameras may also be used to locate and/or monitor for an emergency vehicle in a vicinity of the vehicle 701. Sensor subsystem 710 of in-vehicle computing system 700 may communicate with and receive inputs from various vehicle sensors and may further receive user inputs. While certain vehicle system sensors may communicate with sensor subsystem 710 alone, other sensors may communicate with both sensor subsystem 710 and vehicle control system 730, or may communicate with sensor subsystem 710 indirectly via vehicle control system 730. Sensor subsystem 710 may serve as an interface (e.g., a hardware interface) and/or processing unit for receiving and/or processing received signals from one or more of the sensors described in the disclosure.

A navigation subsystem 711 of in-vehicle computing system 700 may generate and/or receive navigation information such as location information (e.g., via a GPS sensor and/or other sensors from sensor subsystem 710), route guidance, traffic information, point-of-interest (POI) identification, and/or provide other navigational services for the driver. The navigation subsystem 711 may include an inertial navigation system that may further determine a position, orientation, and velocity of the vehicle via motion and rotation sensor inputs. Examples of motion sensors include accelerometers, and examples of rotation sensors include gyroscopes. The navigation subsystem 711 may communicate with motion and rotation sensors included in the sensor subsystem 710. Alternatively, the navigation subsystem 711 may include motion and rotation sensors and determine the movement and rotation based on the output of these sensors. Navigation subsystem 711 may transmit data to, and receive data from a cloud-based server and/or external navigation service via extra-vehicle communication module 724. In some examples, a navigation subsystem may be actively providing navigation guidance or instruction to a driver when an emergency vehicle is detected/located. Accordingly, one or more of the alerts described above may be presented alongside or instead of the navigation guidance or instruction. In some examples, the alert may override a navigation subsystem output. For example, the navigation subsystem may direct a driver to proceed straight through an upcoming intersection in order to travel toward a destination. However, if an emergency vehicle is located near the intersection and/or traveling toward the driver's vehicle, an alert may be presented that overrides the direction of the navigation subsystem. For example, the alert may instruct the user to pull off immediately or to turn at the intersection instead of going straight through the intersection.

External device interface 712 of in-vehicle computing system 700 may be coupleable to and/or communicate with one or more external devices 740 located external to vehicle 701. While the external devices are illustrated as being located external to vehicle 701, it is to be understood that they may be temporarily housed in vehicle 701, such as when the user is operating the external devices while operating vehicle 701. In other words, the external devices 740 are not integral to vehicle 701. The external devices 740 may include a mobile device 742 (e.g., connected via a Bluetooth, NFC, WIFI direct, or other wireless connection) or an alternate Bluetooth-enabled device 752. Mobile device 742 may be a mobile phone, smart phone, wearable devices/sensors that may communicate with the in-vehicle computing system via wired and/or wireless communication, or other portable electronic device(s). Other external devices include external services 746. For example, the external devices may include extra-vehicular devices that are separate from and located externally to the vehicle. Still other external devices include external storage devices 754, such as solid-state drives, pen drives, USB drives, etc. External devices 740 may communicate with in-vehicle computing system 700 either wirelessly or via connectors without departing from the scope of this disclosure. For example, external devices 740 may communicate with in-vehicle computing system 700 through the external device interface 712 over network 760, a universal serial bus (USB) connection, a direct wired connection, a direct wireless connection, and/or other communication link.

One or more applications 744 may be operable on mobile device 742. As an example, mobile device application 744 may be operated to monitor an environment of the vehicle (e.g., collect audio and/or visual data of an environment of the vehicle) and/or to process audio and/or visual data received from vehicle sensors. The collected/processed data may be transferred by application 744 to external device interface 712 over network 760. Likewise, one or more applications 748 may be operable on external services 746. As an example, external services applications 748 may be operated to aggregate and/or analyze data from multiple data sources. For example, external services applications 748 may aggregate data from the in-vehicle computing system (e.g., sensor data, log files, user input, etc.), etc. The collected data may be transmitted to another device and/or analyzed by the application to determine a location of an emergency vehicle and/or to determine a suggested course of action for avoiding interference with the emergency vehicle.

Vehicle control system 730 may include controls for controlling aspects of various vehicle systems 731 involved in different in-vehicle functions. These may include, for example, controlling aspects of vehicle audio system 732 for providing audio output to the vehicle occupants. Audio system 732 may include one or more acoustic reproduction devices including electromagnetic transducers such as speakers. In some examples, in-vehicle computing system 200 may be the only audio source for the acoustic reproduction device or there may be other audio sources that are connected to the audio reproduction system (e.g., external devices such as a mobile phone) to produce audio outputs, such as one or more of the audible alerts described above. The connection of any such external devices to the audio reproduction device may be analog, digital, or any combination of analog and digital technologies.

Vehicle control system 730 may also include controls for adjusting the settings of various vehicle controls 761 (or vehicle system control elements) related to the engine and/or auxiliary elements within a cabin of the vehicle, such as steering controls 762, brake controls 763, lighting controls 764 (e.g., cabin lighting, external vehicle lighting, light signals). For example, the vehicle control system 730 may include controls for adjusting the vehicle controls 761 to present one or more of the above-described alerts (e.g., adjusting cabin lighting, automatically controlling steering or braking to perform an emergency vehicle avoidance maneuver or to allow manual take over for a driver to perform the emergency vehicle avoidance maneuver, etc.). Vehicle controls 761 may also include internal engine and vehicle operation controls (e.g., engine controller module, actuators, valves, etc.) that are configured to receive instructions via the CAN bus of the vehicle to change operation of one or more of the engine, exhaust system, transmission, and/or other vehicle system (e.g., to provide the above-described alert). The control signals may also control audio output (e.g., an audible alert) at one or more speakers of the vehicle's audio system 732. For example, the control signals may adjust audio output characteristics such as volume, equalization, audio image (e.g., the configuration of the audio signals to produce audio output that appears to a user to originate from one or more defined locations to provide a directional alert indicating a location of an emergency vehicle), audio distribution among a plurality of speakers, etc.

In-vehicle computing system 700 may further include an antenna(s) 706, which may be communicatively coupled to external device interface 712 and/or extra-vehicle-communication module 724. The in-vehicle computing system may receive positioning signals such as GPS signals and/or wireless commands via antenna(s) 706 or via infrared or other mechanisms through appropriate receiving devices.

One or more elements of the in-vehicle computing system 700 may be controlled by a user via user interface 718. User interface 718 may include a graphical user interface presented on a touch screen, such as touch screen 608 of FIG. 6, and/or user-actuated buttons, switches, knobs, dials, sliders, etc. For example, user-actuated elements may include steering wheel controls, door and/or window controls, instrument panel controls, audio system settings, climate control system settings, route/route segment quality preference, route/route segment avoidance preference, and the like. A user may also interact with one or more applications of the in-vehicle computing system 700 and mobile device 742 via user interface 718. Notifications and other messages (e.g., alerts), as well as navigational assistance, may be displayed to the user on a display of the user interface. User preferences/information and/or responses to presented alerts may be performed via user input to the user interface.

In another representation, a method of locating an emergency vehicle in proximity to a first vehicle includes monitoring audio output from at least one audio sensor of the first vehicle and image output from at least one image sensor of the first vehicle, detecting one or more of an audible indicator and a visual indicator of an emergency vehicle, and, responsive to detecting the audible indicator of the emergency vehicle, determining a first estimated location of the emergency vehicle based on one or more parameters of the audible indicator, responsive to detecting the visual indicator of the emergency vehicle, determining a second estimated location of the emergency vehicle based on one or more parameters of the visual indicator, responsive to detecting the audio indicator and the visual indicator of the emergency vehicle, determining an updated location of the emergency vehicle based on the first estimated location and the second estimated location, and selectively presenting, via an alert output device of the first vehicle, an alert based on the updated location of the emergency vehicle, the alert including an indication of the updated location of the emergency vehicle.

The disclosure provides for an in-vehicle computing system of a first vehicle, the in-vehicle computing system including an alert output device, a sensor subsystem communicatively coupled to one or more of an audio sensor and an image sensor, a processor, and a storage device storing instructions executable by the processor to monitor one or both of audio output from the audio sensor and image output from the image sensor, detect an audible or visual indicator of an emergency vehicle, and, responsive to detecting the audible or visual indicator of the emergency vehicle, estimate a location of the emergency vehicle based on one or more parameters of the audible or visual indicator, present, via the alert output device, an alert when the estimated location of the emergency vehicle is within an actionable region relative to the first vehicle, the alert including an indication of the estimated location of the emergency vehicle, and present, via the alert output device, no alert or a reduced alert when the estimated location of the emergency vehicle is not within the actionable region. In a first example of the in-vehicle computing system, the instructions additionally or alternatively may be executable to monitor the audio output from the audio sensor by processing the audio output to detect a siren sound. A second example of the in-vehicle computing system optionally includes the first example, and further includes the in-vehicle computing system, wherein processing the audio output to detect the siren sound includes detecting energy in a selected region of an audio band associated with a predetermined siren sound range. A third example of the in-vehicle computing system optionally includes one or both of the first example and the second example, and further includes the in-vehicle computing system, wherein processing the audio output to detect the siren sound includes detecting narrow band and fixed frequency signals in the audio output. A fourth example of the in-vehicle computing system optionally includes one or more of the first through the third examples, and further includes the in-vehicle computing system, wherein processing the audio output to detect the siren sound includes detecting an amplitude modulation pattern in the audio output that matches a selected predetermined amplitude modulation pattern associated with a siren sound pattern. A fifth example of the in-vehicle computing system optionally includes one or more of the first through the fourth examples, and further includes the in-vehicle computing system, wherein processing the audio output to detect the siren sound includes detecting a transition from audio output having an amplitude that is below a threshold amplitude at a given frequency to the audio output having an amplitude that is sustained at an above-the-threshold amplitude at the given frequency for a threshold period of time. A sixth example of the in-vehicle computing system optionally includes one or more of the first through the fifth examples, and further includes the in-vehicle computing system, wherein the instructions are further executable to separate the siren sound from background noise in the audio output to generate a separated siren sound. A seventh example of the in-vehicle computing system optionally includes one or more of the first through the sixth examples, and further includes the in-vehicle computing system, wherein the instructions are executable to estimate the location of the emergency vehicle by performing beamforming on the separated siren sound to estimate a direction of arrival of the siren sound. An eighth example of the in-vehicle computing system optionally includes one or more of the first through the seventh examples, and further includes the in-vehicle computing system, wherein the instructions are executable to estimate, over time, the location of the emergency vehicle based on the separated siren sound, and wherein the instructions are further executable to determine a trajectory of the emergency vehicle based on changes of the location of the emergency vehicle over time. A ninth example of the in-vehicle computing system optionally includes one or more of the first through the eighth examples, and further includes the in-vehicle computing system, wherein the emergency vehicle is determined to be in the actionable region responsive to determining that the trajectory of the emergency vehicle intersects with a location of the first vehicle. A tenth example of the in-vehicle computing system optionally includes one or more of the first through the ninth examples, and further includes the in-vehicle computing system, wherein the instructions are executable to determine that the trajectory of the emergency vehicle is directed away from the first vehicle or does not intersect with a location of the first vehicle, and, in response, output the reduced alert including an indication that the emergency vehicle is heading away from the first vehicle. An eleventh example of the in-vehicle computing system optionally includes one or more of the first through the tenth examples, and further includes the in-vehicle computing system, wherein presenting the alert includes presenting a suggestion of an action for a driver of the first vehicle to perform to maneuver away from a path of the emergency vehicle or to maintain one or more of a current speed and a current lane occupation based on the location of the emergency vehicle. A twelfth example of the in-vehicle computing system optionally includes one or more of the first through the eleventh examples, and further includes the in-vehicle computing system, wherein the suggestion of the action is determined based on one or more features of a roadway on which the first vehicle is traveling and wherein the suggestion of the action overrides a navigation instruction from a navigation application. A thirteenth example of the in-vehicle computing system optionally includes one or more of the first through the twelfth examples, and further includes the in-vehicle computing system, wherein the instructions are executable to monitor the image output from the image sensor by processing captured images to match features in the images to one or more predetermined emergency vehicle features, and wherein the instructions are executable to estimate the location of the emergency vehicle based on a location of features in the image that match the one or more predetermined emergency vehicle features. A fourteenth example of the in-vehicle computing system optionally includes one or more of the first through the thirteenth examples, and further includes the in-vehicle computing system, wherein the instructions are executable to monitor the image output from the image sensor by processing captured images to compare a detected pattern of movement of neighboring vehicles to a predetermined emergency vehicle avoidance pattern, and wherein the instructions are executable to estimate the location of the emergency vehicle based on the detected pattern of movement of neighboring vehicles.

The disclosure further provides for a method for displaying information to an operator of a first vehicle, the method including identifying a relative location of an emergency vehicle to the first vehicle from monitored audio and/or video sensed by the vehicle, and displaying the identified relative location on a display in the vehicle. In a first example of the method, the method further includes, responsive to detecting an audible indicator of the emergency vehicle from the monitored audio sensed by the vehicle, determining a first estimated trajectory of the emergency vehicle based on one or more parameters of the audible indicator as detected over time, responsive to detecting a visual indicator of the emergency vehicle from the monitored video sensed by the vehicle, determining a second estimated trajectory of the emergency vehicle based on one or more parameters of the visual indicator as detected over time, and, responsive to detecting the audio indicator and the visual indicator of the emergency vehicle, determining an updated trajectory of the emergency vehicle based on the first estimated trajectory and the second estimated trajectory. A second example of the method optionally includes the first example, and further includes the method, wherein one or more of the first estimated trajectory, the second estimated trajectory, and the updated trajectory is further determined based on a parameter of a roadway on which the emergency vehicle is traveling. A third example of the method optionally includes one or both of the first example and the second example, and further includes the method, further comprising, presenting an alert including the identified relative location and a suggestion for performing an action to avoid the emergency vehicle responsive to determining that the updated trajectory of the emergency vehicle intersects with a location of the first vehicle.

The disclosure also provides for an in-vehicle computing system including an alert output device, a sensor subsystem communicatively coupled to one or more of an audio sensor and an image sensor, a processor, and a storage device storing instructions executable by the processor to detect an audible indicator of an emergency vehicle based on audio output from the audio sensor, responsive to detecting the audible indicator of the emergency vehicle, determine a first estimated location of the emergency vehicle based on one or more parameters of the audible indicator, monitor image output from the image sensor, responsive to not detecting any visual indicator of the emergency vehicle based on the image output, selectively present, via the alert output device, a first alert based on the first estimated location of the emergency vehicle, the first alert including an indication of the first estimated location of the emergency vehicle, and, responsive to detecting a visual indicator of the emergency vehicle based on the image output, determine a second estimated location of the emergency vehicle based on one or more parameters of the image output, adjust the first estimated location based on the second estimated location to generate an updated location of the emergency vehicle, and selectively present, via the alert output device, a second alert based on the updated location of the emergency vehicle, the second alert including an indication of the updated location of the emergency vehicle.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the in-vehicle computing system 609 and/or 700 described with reference to FIGS. 6 and 7. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. An in-vehicle computing system of a first vehicle, the in-vehicle computing system comprising:

an alert output device;

a sensor subsystem communicatively coupled to one or more of an audio sensor and an image sensor;

a processor; and a storage device storing instructions executable by the processor to:

identify a relative location of an emergency vehicle to the first vehicle from monitored audio and/or video sensed by the sensor subsystem; and output the identified relative location via the alert output device, wherein the instructions are executable to identify the relative location of the emergency vehicle by processing audio output from the monitored audio sensor to detect a siren sound, and wherein:

processing the audio output to detect the siren sound includes detecting a transition from audio output having an amplitude that is below a threshold amplitude at a given frequency to the audio output having an amplitude that is sustained at an above-the-threshold amplitude at the given frequency for a threshold period of time, or the instructions are further executable to separate the siren sound from background noise in the audio output to generate a separated siren sound and the instructions are further executable to estimate the relative location of the emergency vehicle by performing beamforming on the separated siren sound to estimate a direction of arrival of the siren sound.

2. The in-vehicle computing system of claim 1, wherein processing the audio output to detect the siren sound includes detecting energy in a selected region of an audio band associated with a predetermined siren sound range.

3. The in-vehicle computing system of claim 1, wherein processing the audio output to detect the siren sound includes detecting narrow band and fixed frequency signals in the audio output.

4. The in-vehicle computing system of claim 1, wherein processing the audio output to detect the siren sound includes detecting an amplitude modulation pattern in the audio output that matches a selected predetermined amplitude modulation pattern associated with a siren sound pattern.

5. The in-vehicle computing system of claim 1, wherein the instructions are executable to estimate, over time, the relative location of the emergency vehicle based on the separated siren sound, and wherein the instructions are further executable to determine a trajectory of the emergency vehicle based on changes of the relative location of the emergency vehicle over time.

6. The in-vehicle computing system of claim 5, wherein the instructions are executable to output the identified relative location via the alert output device when the emergency vehicle is determined to be in an actionable region responsive to determining that the trajectory of the emergency vehicle intersects with a location of the first vehicle.

7. The in-vehicle computing system of claim 5, wherein the instructions are executable to determine that the trajectory of the emergency vehicle is directed away from the first vehicle or does not intersect with a location of the first vehicle, and, in response, output a reduced alert including an indication that the emergency vehicle is heading away from the first vehicle.

8. The in-vehicle computing system of claim 1, wherein outputting the alert includes presenting a suggestion of an action for a driver of the first vehicle to perform to maneuver away from a path of the emergency vehicle or to maintain one or more of a current speed and a current lane occupation based on the location of the emergency vehicle.

9. The in-vehicle computing system of claim 8, wherein the suggestion of the action is determined based on one or more features of a roadway on which the first vehicle is traveling and wherein the suggestion of the action overrides a navigation instruction from a navigation application.

10. The in-vehicle computing system of claim 1, wherein the instructions are executable to identify the relative location of the emergency vehicle to the first vehicle by processing captured images from the monitored image sensor to match features in the images to one or more predetermined emergency vehicle features, and wherein the instructions are executable to estimate a location of the emergency vehicle based on a location of features in the image that match the one or more predetermined emergency vehicle features.

11. The in-vehicle computing system of claim 1, wherein the instructions are executable to identify the relative location of the emergency vehicle to the first vehicle by processing captured images from the monitored image sensor to compare a detected pattern of movement of neighboring vehicles to a predetermined emergency vehicle avoidance pattern, and wherein the instructions are executable to estimate a location of the emergency vehicle based on the detected pattern of movement of neighboring vehicles.

12. A method for displaying information to an operator of a first vehicle, the method comprising:

identifying a relative location of an emergency vehicle to the first vehicle from monitored audio and/or video sensed by the vehicle; and displaying the identified relative location on a display in the vehicle, wherein displaying the identified relative location on the display in the vehicle further comprises presenting a suggestion of an action for the operator of the first vehicle to perform to maneuver away from a path of the emergency vehicle or to maintain a current speed or a current lane occupation based on the identified relative location of the emergency vehicle, wherein the suggestion of the action is determined based on one or more features of a roadway on which the first vehicle is traveling and wherein the suggestion of the action overrides a navigation instruction from a navigation application.

13. The method of claim 12, further comprising:

responsive to detecting an audible indicator of the emergency vehicle from the monitored audio sensed by the vehicle, determining a first estimated trajectory of the emergency vehicle based on one or more parameters of the audible indicator as detected over time;

responsive to detecting a visual indicator of the emergency vehicle from the monitored video sensed by the vehicle, determining a second estimated trajectory of the emergency vehicle based on one or more parameters of the visual indicator as detected over time; and responsive to detecting the audio indicator and the visual indicator of the emergency vehicle, determining an updated trajectory of the emergency vehicle based on the first estimated trajectory and the second estimated trajectory.

14. The method of claim 13, wherein one or more of the first estimated trajectory, the second estimated trajectory, and the updated trajectory is further determined based on a parameter of a roadway on which the emergency vehicle is traveling.

15. The method of claim 13, further comprising presenting an alert including the identified relative location and a suggestion for performing an action to avoid the emergency vehicle responsive to determining that the updated trajectory of the emergency vehicle intersects with a location of the first vehicle.

16. An in-vehicle computing system comprising:

an alert output device;

a sensor subsystem communicatively coupled to one or more of an audio sensor and an image sensor;

a processor; and a storage device storing instructions executable by the processor to:

detect an audible indicator of an emergency vehicle based on audio output from the audio sensor;

responsive to detecting the audible indicator of the emergency vehicle:

determine a first estimated location of the emergency vehicle based on one or more parameters of the audible indicator;

monitor image output from the image sensor;

responsive to not detecting any visual indicator of the emergency vehicle based on the image output, selectively present, via the alert output device, a first alert based on the first estimated location of the emergency vehicle, the first alert including an indication of the first estimated location of the emergency vehicle; and responsive to detecting a visual indicator of the emergency vehicle based on the image output:

determine a second estimated location of the emergency vehicle based on one or more parameters of the image output;

adjust the first estimated location based on the second estimated location to generate an updated location of the emergency vehicle; and selectively present, via the alert output device, a second alert based on the updated location of the emergency vehicle, the second alert including an indication of the updated location of the emergency vehicle.

* * * * *